US007482754B2

(12) United States Patent
Eom

(10) Patent No.: US 7,482,754 B2
(45) Date of Patent: Jan. 27, 2009

(54) PLASMA DISPLAY PANEL

(75) Inventor: Ki-Jong Eom, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 514 days.

(21) Appl. No.: 11/202,193

(22) Filed: Aug. 12, 2005

(65) Prior Publication Data

US 2006/0033437 A1 Feb. 16, 2006

(30) Foreign Application Priority Data

Aug. 13, 2004 (KR) ..... 10-2004-0063767
Aug. 20, 2004 (KR) ..... 10-2004-0065884

(51) Int. Cl.
*H01J 17/49* (2006.01)

(52) U.S. Cl. ..... 313/586; 313/582

(58) Field of Classification Search ..... 313/582–587
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,742,122 | A * | 4/1998 | Amemiya et al. | 313/582 |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 2005/0029941 | A1 * | 2/2005 | Kwon et al. | 313/582 |
| 2005/0057444 | A1 * | 3/2005 | Ko | 345/60 |

FOREIGN PATENT DOCUMENTS

| | | |
|---|---|---|
| JP | 02-148645 | 6/1990 |
| JP | 2845183 | 10/1998 |

(Continued)

OTHER PUBLICATIONS

Korean Office Action of the Korean Patent Application No. 10-2004-0063767, mailed on Feb. 28, 2006.

(Continued)

*Primary Examiner*—Vip Patel
(74) *Attorney, Agent, or Firm*—Robert E. Bushnell, Esq.

(57) ABSTRACT

A plasma display panel includes an upper substrate; an upper dielectric layer formed on a lower surface of the upper substrate; a lower substrate facing the upper substrate; a lower dielectric layer formed on an upper surface of the lower substrate; a plurality of address electrodes disposed in the lower dielectric layer and separated from each other; a plurality of barrier ribs, including longitudinal barrier ribs that extend between and parallel to the address electrodes and separated from each other, disposed between the upper substrate and the lower substrate; a phosphor layer formed in discharge spaces disposed between the longitudinal barrier ribs; and a plurality of pairs of sustain electrodes disposed in the upper dielectric layer, each of the pairs including: a first sustain electrode and a second sustain electrode protruding outward respectively from the adjacent longitudinal barrier ribs over the discharge space disposed between them to discharge gap.

20 Claims, 8 Drawing Sheets

FOREIGN PATENT DOCUMENTS

| | | | |
|---|---|---|---|
| JP | 2917279 | | 4/1999 |
| JP | 2000-243300 | | 9/2000 |
| JP | 2001-043804 | | 2/2001 |
| JP | 2001-325888 | | 11/2001 |
| JP | 2004-127785 | | 4/2004 |
| KR | 10-2001-0058561 | | 7/2001 |
| KR | 10-2001-0058706 | | 7/2001 |
| KR | 2001-0058562 | | 7/2001 |
| KR | 2001113161 | A * | 12/2001 |
| KR | 10-2003-0042538 | | 6/2003 |
| KR | 10-0447121 | | 9/2004 |

OTHER PUBLICATIONS

Korean Office Action of the Korean Patent Application No. 10-2004-0065884, mailed on Mar. 30, 2006.

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

Korean Office Action for Korean Patent Application Nos. 2004-65884, issued on Sep. 29, 2006.

* cited by examiner

PLASMA DISPLAY PANEL

CLAIM OF PRIORITY

This application makes reference to, incorporates the same herein, and claims all benefits accruing under 35 U.S.C. § 119 from applications for PLASMA DISPLAY PANEL earlier filed in the Korean Intellectual Property Office on 13 Aug. 2004 and there duly assigned Serial No. 10-2004 -0063767, and for PLASMA DISPLAY PANEL earlier filed in the Korean Intellectual Property Office on 20 Aug. 2004 and there duly assigned Serial No. 10-2004-0065884.

BACKGROUND OF THE INVENTION

1. Field of the Invention

The present invention relates to a plasma display panel, and more particularly, to a plasma display panel having an improved structure so that a light emission brightness and discharge efficiency can be improved.

2. Description of the Related Art

In general, an image is formed in a plasma display panel by generating a glow discharge by applying a predetermined voltage to electrodes in a state where a gas is filled between the electrodes, which are disposed in a sealed space, and exciting a phosphor layer that is formed in a predetermined pattern using ultraviolet rays generated during the glow discharge operation.

Plasma display panels can be classified into a direct current (DC) plasma display panels and alternating current (AC) plasma display panels according to their driving methods. In addition, the plasma display panel can be classified into a two-electrode type or a three-electrode type according to the number of electrodes they include. A DC plasma display panel includes an auxiliary electrode in order to induce an auxiliary discharge, and an AC plasma display panel includes an address electrode for improving address speed by a dividing address discharge and a sustain discharge. Also, an AC plasma display panel can be classified into an opposing discharge type and a surface discharge type according to the arrangement of the electrodes performing the discharge. The opposing discharge type AC plasma display panel includes two sustain electrodes forming the discharge disposed on two substrates respectively to generate the discharge perpendicularly to the panel, and the surface discharge type includes two sustain electrodes that are disposed on one substrate to generate the discharge on a surface of the substrate.

An AC plasma display panel having a general surface discharge type three-electrode structure is described as follows.

The plasma display panel includes an upper substrate on which an image is displayed, and a lower substrate disposed parallel to the upper substrate.

Pairs of sustain electrodes including common electrodes and scan electrodes are formed on a lower surface of the upper substrate. The common electrode and the scan electrode are separated from each other by a discharge gap (g). The common electrode includes a common transparent electrode and a common bus electrode formed on a lower surface of the common transparent electrode, and the scan electrode includes a scan transparent electrode and a scan bus electrode formed on a lower surface of the scan transparent electrode. The pairs of sustain electrodes are covered by an upper dielectric layer, and a protective layer is formed on a lower surface of the upper dielectric layer.

In addition, the lower substrate faces the upper substrate, and address electrodes are formed on an upper surface of the lower substrate perpendicularly to the sustain electrode pairs.

The address electrodes are covered by a lower dielectric layer. Barrier ribs including longitudinal barrier ribs and transverse barrier ribs crossing the longitudinal barrier ribs are formed on the upper surface of the lower dielectric layer to define discharge cells in a matrix form. The barrier ribs are formed such that regions where the sustain electrode pairs and the address electrodes cross each other correspond to the discharge cells. In the discharge cells, red, green, and blue phosphor layers are selectively formed in order to realize colors, and a discharge gas is filled in the discharge cells.

In the plasma display panel having the above structure, the pairs of sustain electrodes can have various structures. The common transparent electrode of the common electrode and the scan transparent electrode of the scan electrode constituting the pair of sustain electrodes are formed as strips, and the common and scan transparent electrodes form the discharge gap (g) in the discharge cell. The discharge between the common and scan transparent electrodes starts at the discharge gap (g), and is diffused to the entire discharge cell.

In order to diffuse the discharge started at the discharge gap (g) into the entire discharge cell efficiently, the initial discharge should occur in wide area. However, when the discharge gap (g) has a predetermined width, the initial discharge occurs locally and the diffusion of discharge cannot be performed sufficiently. When the discharge is generated by applying voltages to the common and scan bus electrodes, a constant electric field is not formed between the common and scan transparent electrodes, and thus, unnecessary portion for the discharge increases in the common and scan transparent electrodes. The unnecessary portion lowers the discharge efficiency in the discharge cell, and blocks a large portion of the discharge cell, thereby lowering emission brightness.

SUMMARY OF THE INVENTION

The present invention provides a plasma display panel having an improved electrode structure so that light emission brightness and discharge efficiency can be improved.

The present invention also provides a plasma display panel that is easy to control the size of a discharge area, and therefore the emission brightness and the color temperature can be increased and the address voltage margin can be sufficiently ensured.

The present invention provides in addition, a plasma display panel with a structure where the discharge stability can be ensured and the efficiency of the discharge operation can be improved, while being easy to implement and cost effective.

According to an aspect of the present invention, there is provided a plasma display panel including: an upper substrate; an upper dielectric layer formed on a lower surface of the upper substrate; a lower substrate facing the upper substrate; a lower dielectric layer formed on an upper surface of the lower substrate; a plurality of address electrodes disposed in the lower dielectric layer and separated from each other; a plurality of barrier ribs, including longitudinal barrier ribs that extend between and parallel to the address electrodes and separated from each other, disposed between the upper substrate and the lower substrate; a phosphor layer formed in discharge spaces disposed between the longitudinal barrier ribs; and a plurality of pairs of sustain electrodes disposed in the upper dielectric layer, each of the pairs including: a first sustain electrode and a second sustain electrode protruding outward respectively from the adjacent longitudinal barrier ribs over the discharge space disposed between them to discharge gap.

The first sustain electrode including first transparent electrodes protruding outward from the longitudinal barrier ribs over the discharge spaces and a first bus electrode to which the first transparent electrodes are connected; and the second sustain electrode including second transparent electrodes protruding outward from the longitudinal barrier ribs over the discharge spaces to form discharge gaps with the first transparent electrodes and a second bus electrode to which the second transparent electrodes are connected.

The phosphor layer may include red, green, and blue color phosphor layers emitting red, green, and blue lights respectively, and areas of portions of the first and second transparent electrodes that are disposed above the phosphor layer and have the lowest maximum brightness level may be greater than those of portions of the first and second transparent electrodes that are disposed above the other phosphor layers.

The phosphor layer may include red, green, and blue color phosphor layers emitting of red, green, and blue lights respectively, and areas of portions of the first and second transparent electrodes that are disposed above the phosphor layer having the lowest address voltage margin may be greater than those of portions of the first and second transparent electrodes that are disposed above the other phosphor layers.

The plasma display panel may further include at least one floating electrode between the first transparent electrode and the second transparent electrode.

Recess portions may be formed at edges of the first and second transparent electrodes forming the discharge gap, and the floating electrode may be disposed between the first and second recess portions.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
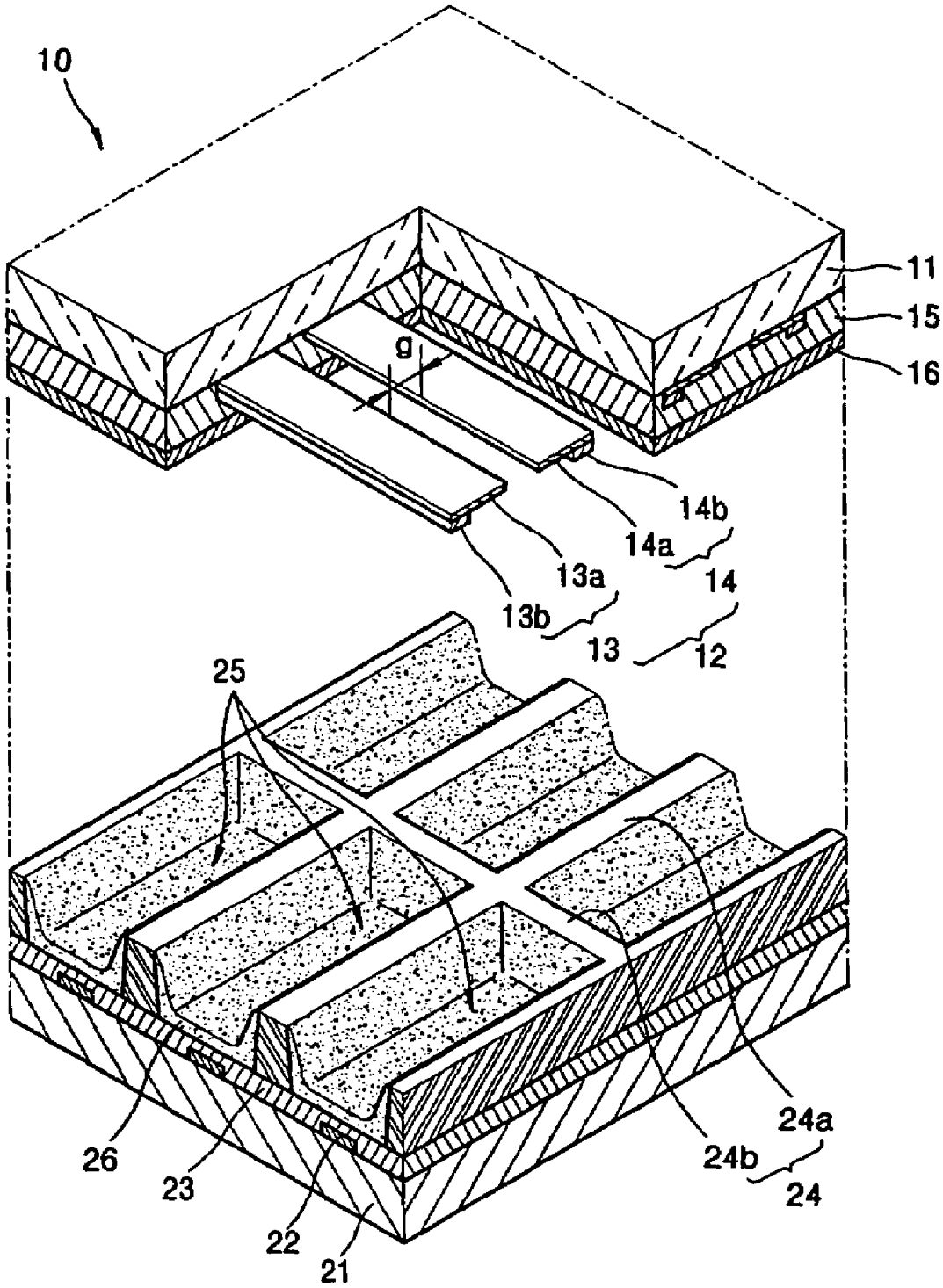
FIG. 1 (CONVENTIONAL ART)
FIG. 1 is an exploded perspective view of a plasma display panel according to the conventional art.

Turning now to the drawings, FIG. 1 is a perspective view of an AC plasma display panel 10 having a general surface discharge type three-electrode structure.

Referring to FIG. 1, the plasma display panel 10 includes an upper substrate 11 on which an image is displayed, and a lower substrate 21 disposed parallel to the upper substrate 11.

Pairs of sustain electrodes 12 including common electrodes 13 and scan electrodes 14 are formed on a lower surface of the upper substrate 11. The common electrode 13 and the scan electrode 14 are separated from each other by a discharge gap (g). The common electrode 13 includes a common transparent electrode 13*a* and a common bus electrode 13*b* formed on a lower surface of the common transparent electrode 13*a*, and the scan electrode 14 includes a scan transparent electrode 14*a* and a scan bus electrode 14*b* formed on a lower surface of the scan transparent electrode 14*a*. The pairs of sustain electrodes 12 are covered by an upper dielectric layer 15, and a protective layer 16 is formed on a lower surface of the upper dielectric layer 15.

In addition, the lower substrate 21 faces the upper substrate 11, and address electrodes 22 are formed on an upper surface of the lower substrate 21 perpendicularly to the sustain electrode pairs 12. The address electrodes 22 are covered by a lower dielectric layer 23. Barrier ribs 24 including longitudinal barrier ribs 24*a* and transverse barrier ribs 24*b* crossing the longitudinal barrier ribs 24*a* are formed on the upper surface of the lower dielectric layer 23 to define discharge cells 25 in a matrix form. The barrier ribs 24 are formed such that regions where the sustain electrode pairs and the address electrodes 22 cross each other correspond to the discharge cells 25. In the discharge cells 25, red, green, and blue phosphor layers 26 are selectively formed in order to realize colors, and a discharge gas is filled in the discharge cells 25.

In the plasma display panel 10 having the above structure, the pairs of sustain electrodes 12 can have various structures. Referring to FIG. 1, for example, the common transparent electrode 13*a* of the common electrode 13 and the scan transparent electrode 14*a* of the scan electrode 14 constituting the pair of sustain electrodes 12 are formed as strips, and the common and scan transparent electrodes 13*a* and 14*a* form the discharge gap (g) in the discharge cell 25. The discharge between the common and scan transparent electrodes 13*a* and 14*a* starts at the discharge gap (g), and is diffused to the entire discharge cell 25.

In order to diffuse the discharge started at the discharge gap (g) into the entire discharge cell 25 efficiently, the initial discharge should occur in wide area. However, when the discharge gap (g) has a predetermined width, as shown in FIG. 1, the initial discharge occurs locally and the diffusion of discharge cannot be performed sufficiently. When the discharge is generated by applying voltages to the common and scan bus electrodes 13*b* and 14*b*, a constant electric field is not formed between the common and scan transparent electrodes 13*a* and 14*a*, and thus, unnecessary portion for the discharge increases in the common and scan transparent electrodes 13*a* and 14*a*. The unnecessary portion lowers the discharge efficiency in the discharge cell 25, and blocks a large portion of the discharge cell 25, thereby lowering emission brightness.

Figure 2:
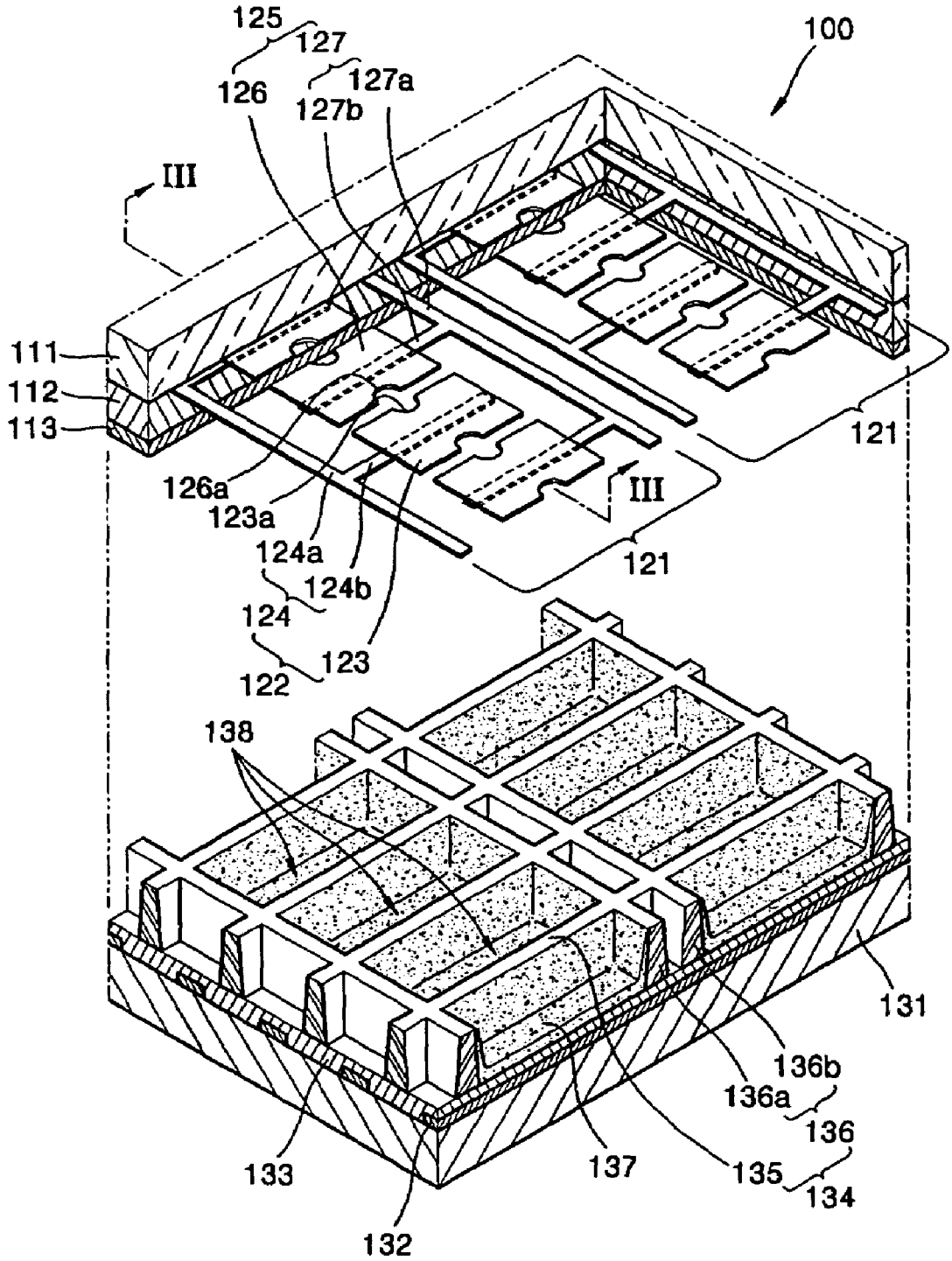
FIG. 2 is an exploded perspective view of a plasma display panel according to an embodiment of the present invention.
Figure 3:
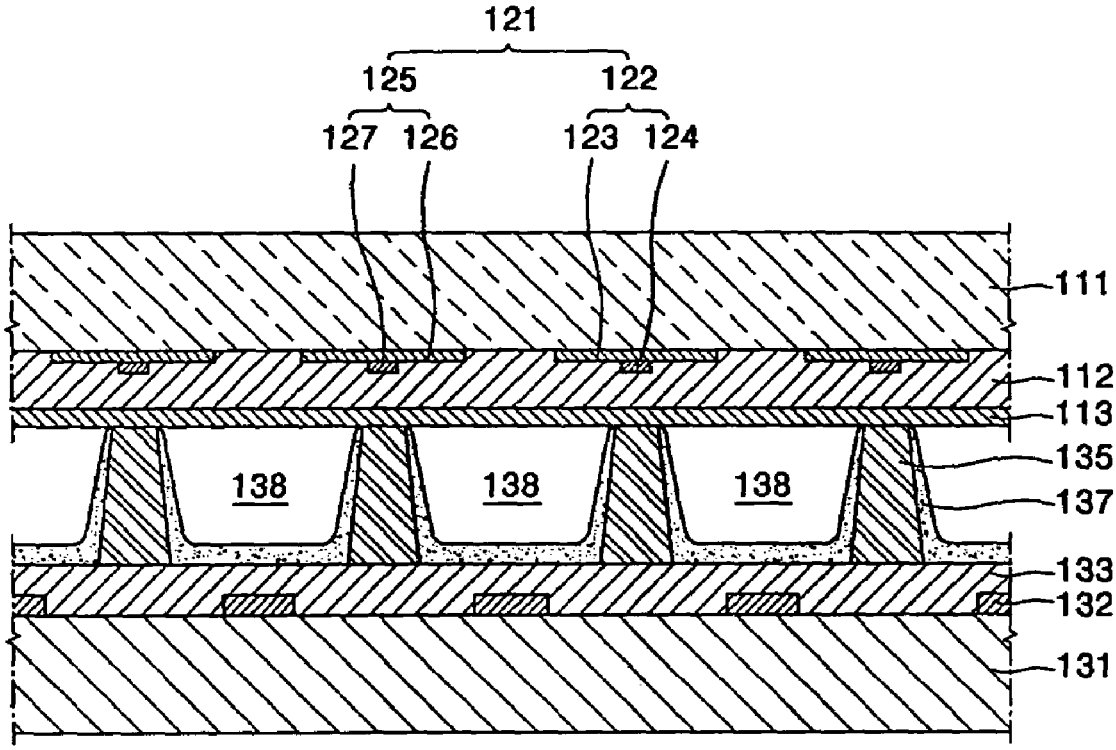
FIG. 3 is a cross-sectional view of the plasma display panel along line III-III of FIG. 2.
Figure 4:
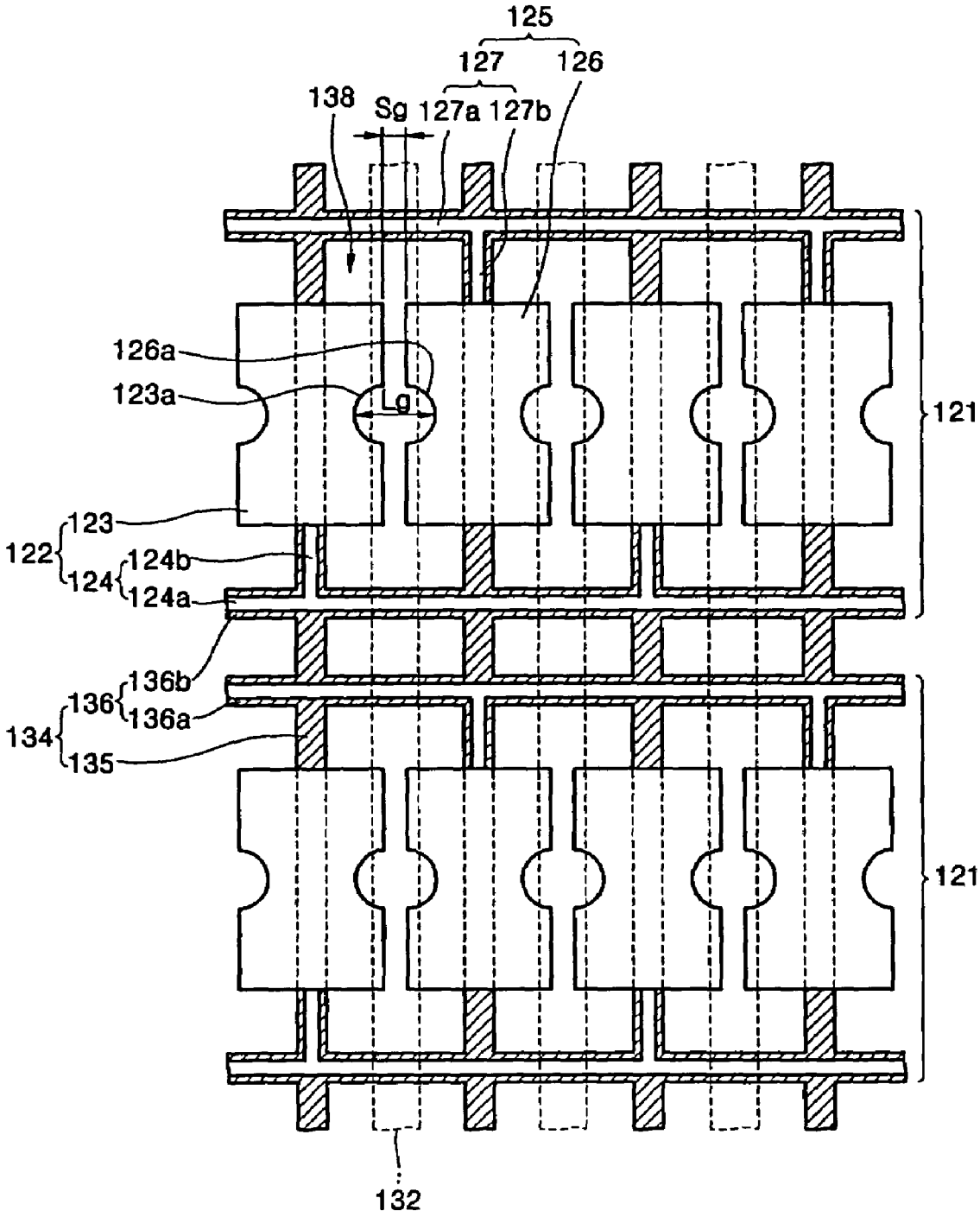
FIG. 4 is a plan view of pairs of sustain electrodes arranged on discharge cells in the plasma display panel of FIG. 2.

FIG. 2 is a perspective view of a plasma display panel 100 according to an embodiment of the present invention, FIG. 3 is a cross-sectional view of the plasma display panel along line III-III of FIG. 2, and FIG. 4 is a plan view of pairs of sustain electrodes arranged on discharge cells in the plasma display panel of FIG. 2.

Referring to FIGS. 2 through 4, the plasma display panel 100 includes an upper substrate 111, and a lower substrate 131 facing the upper substrate 111.

The upper substrate 111 is formed of a transparent material such as glass, through which visible rays can transmit, so as to display an image. Pairs of sustain electrodes 121 are formed on a lower surface of the upper substrate 111. The sustain electrode pairs 121 will be described in detail later.

The pairs of sustain electrodes 121 are covered by an upper dielectric layer 112 that is formed of a dielectric material such as PbO, $B_2O_3$, or $SiO_2$, and the upper dielectric layer 112 prevents the pairs of sustain electrodes 121 from being damaged by the direct impact of charged particles onto the sustain electrode pairs 121 during the discharge operation and induces the charged particles.

In addition, the lower surface of the upper dielectric layer 112 can be covered by a protective layer 113 formed of MgO, and the protective layer 113 prevents the upper dielectric layer 112 from being damaged by the direct impact of the charged particles onto the upper dielectric layer 112 during the discharge operation. In addition, when the charged particles collide with the protective layer 113, the protective layer 113 can emit secondary electrons to improve the discharge efficiency.

Address electrodes 132 are formed as separated parallel strips on an upper surface of the lower substrate 131 facing the upper substrate 111 orthogonally to the sustain electrode pairs 121. The address electrodes 132 are covered by a lower dielectric layer 133, and barrier ribs 134 are formed on the lower dielectric layer 133 in a predetermined pattern.

The barrier ribs 134 define a discharge space, where the discharge occurs, that is, discharge cells 138, and prevents cross talk from occurring between neighboring discharge cells 138. The barrier ribs 134 include longitudinal barrier ribs 135 separated from each other, and transverse barrier ribs 136 extending in the same plane as, and perpendicular to, the longitudinal barrier ribs 135 and separated from each other, and define the discharge cells 138 as closed structures.

The longitudinal barrier ribs 135 extend parallel to the address electrodes 132, and each of the address electrodes 132 can be disposed between two neighboring longitudinal barrier ribs 135. In addition, the transverse barrier ribs 136 can include first and second transverse barrier ribs 136*a* and 136*b* that are separated from each other to form a space therebetween. A region including the space between the first and second transverse barrier ribs 136*a* and 136*b* is a non-discharge area, and the space between the first and second transverse barrier ribs 136*a* and 136*b* can act as an air exhaustion path. The arrangement of the barrier ribs 134 is not limited to the structure described above, and the barrier ribs 134 can have various structures such as stripes without the transverse barrier ribs 136.

Phosphor layers 137 excited by ultraviolet rays generated in the discharge operation to emit visible rays are disposed in the discharge cells 138 defined by the barrier ribs 134 having the above described structure. The phosphor layer 137 can be formed on the sides of the barrier ribs 134 and portions of the lower dielectric layer 133 exposed by the barrier rib 134. The phosphor layer 137 can be formed of red, green, and blue color phosphors for displaying colors, and accordingly, the phosphor layer 137 can be divided into red, green, and blue color layers in the discharge cells 138. A discharge gas containing Ne and Xe is filled in the discharge cells 138 in which the phosphor layers 137 are disposed.

The pair of sustain electrodes 121 includes a first sustain electrode 122 and a second sustain electrode 125. One of the first and second sustain electrodes 122 and 125 functions as a common electrode, and the other functions as a scan electrode.

The first sustain electrodes 122 include first transparent electrodes 123 disposed on one side of the discharge cells 138, and first bus electrodes 124, to which the first transparent electrodes 123 are commonly connected. The second sustain electrodes 125 include second transparent electrodes 126 disposed on the other sides of the discharge cells 138 to form discharge gaps with the first transparent electrodes 123, and second bus electrodes 127, to which the second transparent electrodes 126 are connected.

In more detail, the first transparent electrodes 123 of the first sustain electrodes 122 protrude outward from the longitudinal barrier ribs 135 over the discharge cells 138, with predetermined distances. In addition, the second transparent electrodes 126 of the second sustain electrodes 125 protrude outward from the longitudinal barrier ribs 135 over the discharge cells 138 with predetermined distances, and are separated from the first transparent electrodes 123 as much as predetermined gaps to form the discharge gap at each discharge cell 138.

The first and second transparent electrodes 123 and 126 can be disposed on two neighboring longitudinal barrier ribs 135 respectively. That is, the first transparent electrodes 123 are disposed on odd barrier ribs 135, and the second transparent electrodes 126 are disposed on even barrier ribs 135, thus the first and second transparent electrodes 123 and 126 can be alternately disposed on the longitudinal barrier ribs 135. The first transparent electrodes 123 disposed on the odd longitudinal barrier ribs 135 protrude over the discharge cells 138 located on both sides of the longitudinal barrier ribs 135 and are disposed at the discharge cells 138, and the second transparent electrodes 126 disposed on the even longitudinal barrier ribs 135 protrude toward the discharge cells 138 located on the both sides of the longitudinal barrier ribs 135 and are disposed on the discharge cells 138.

Since the first and second transparent electrodes 123 and 126 disposed on the discharge cells 138 are formed as squares and protrude outward from the longitudinal barrier ribs 135 toward the discharge cells 138, the area in the discharge cell 138 where the discharge occurs can be increased, that is, a pitch between the transverse barrier ribs 136 is greater than that between the longitudinal barrier ribs 135. That is, a unit pixel includes three discharge cells 138 that emit red, green, and blue color visible rays, respectively, and since unit pixels are generally formed squares, the pitch between the transverse barrier ribs 136 can be three times greater than that between the longitudinal barrier ribs 135. When the pitch between the transverse barrier ribs 136 is three times larger than that between the longitudinal barrier ribs 135, since the first and second transparent electrodes 123 and 126 protrude outward from the longitudinal barrier ribs 135 over the discharge cells 138, the area where the discharge occurs can be greater than the area where discharge occurs in the conventional art, that is, the transparent electrodes respectively protrude from the transverse barrier ribs toward the discharge cells. Accordingly, low-voltage driving can be performed, and brightness can be improved.

The first and second transparent electrodes 123 and 126 are formed of a transparent material such as indium tin oxide (ITO) so as not to interrupt the transmission of the visible rays emitted from the phosphor layers 137 through the upper substrate 111.

A first recess portion 123*a* and a second recess portion 126*a* with predetermined curvatures are recessed into edges of the first and second transparent electrodes 123 and 126, which form the discharge gap. Accordingly, a long gap (Lg) is formed between the first recess portion 123*a* of the first transparent electrode 123 and the second recess portion 126*a* of the second transparent electrode 126, and a short gap (Sg) narrower than Lg is formed between the first and second transparent electrodes 123 and 126 where the first and second recess portions 123*a* and 126*a* are not formed. Since the first and second recess portions 123*a* and 126*a* formed on the first and second transparent electrodes 123 and 126 divided the discharge gap into the long gap (Lg) and the short gap (Sg), the discharge can be concentrated in the center portion to make the discharge stable, and the end portions, except for the first and second recess portions 123*a* and 126*a*, forming the short gap (Sg) can lower the discharge starting voltage, thus improving the discharge efficiency. That is, the sustain discharge starts at the short gap (Sg) and is diffused toward the long gap (Lg) and the entire discharge cell 138.

The first and second transparent electrodes 123 and 126, which have the above structures, are connected to the first and second bus electrodes 124 and 127, respectively. Accordingly, the first and second bus electrodes 124 and 127 apply the voltage supplied from a driving unit to the first and second transparent electrodes 123 and 126. Thus, the first and second bus electrodes 124 and 127 can be formed of a metal having high conductivity, for example, Ag or Au, in order to improve the electrical resistances of the first and second transparent electrodes 123 and 126, which are formed of the ITO (indium tin oxide), which has a relatively low conductivity. Each of the first and second bus electrodes 124 and 127 may further include a black color layer in order to absorb external lights and improve contrast, and the black color layer can be formed of Ru, Co, or Mn.

The first bus electrodes 124 include first base portions 124*a* that intersect the longitudinal barrier ribs 135, and first connecting portions 124*b* that extend from the first base portions 124*a* toward the first transparent electrodes 123 and are connected to the first transparent electrodes 123. In addition, the second bus electrodes 127 include second base portions 127*a* that intersect the longitudinal barrier ribs 135, and second connection portions 127*b* that extend from the second base portions 127*a* toward the second transparent electrodes 126 and are connected to the second transparent electrodes 126.

The first and second base portions 124*a* and 127*a* can be disposed on the transverse barrier ribs 126 above the non-discharge area in order to increase an aperture rate of the panel 100. For example, referring to FIG. 4, when each of the transverse barrier ribs 136 includes first and second transverse barrier ribs 136*a* and 136*b* that are separated from each other, the first base portion 124*a* of one pair of the sustain electrodes 121 and the second base portion 127*a* of another pair of the sustain electrodes 121 can be respectively disposed at the first transverse barrier ribs 136*a* and the second transverse barrier ribs 136*b*.

The first connection portions 124*b*, which extend from the first base portions 124*a*, are disposed on the longitudinal barrier ribs 135, on which the first transparent electrodes 123*a* are disposed, and the second connection portions 127*b*, which extend from the second base portions 127*a*, are disposed on the longitudinal barrier ribs 135, on which the second transparent electrodes 126 are disposed, in order to improve the aperture rate of the panel 100. In addition, the first and second connection portions 124*b* and 127*b* can extend to edges of the first and second transparent electrodes 123 and 126 through the center portions of the transparent electrodes 123 and 126, and this is desirable when the first and second connection portion 124*b* and 127*b* have the black color layers, because the external light can be absorbed by the black color layers, thereby improving contrast. However, the first and second connection portions are not limited to the above structures, and can have any structure if the first and second base portions are respectively connected to the first and second transparent electrodes.

In addition, the discharge cells 138 on which the red color phosphor layer is disposed function as red-color sub-pixels, the discharge cells 138 on which the green color phosphor layer is disposed function as green-color sub-pixels, and the discharge cells 138 on which the blue color phosphor layer is disposed function as blue-color sub-pixels. The red, green, and blue color sub-pixels constitute a unit pixel, and therefore each of the unit pixels can represent different colors formed by combinations of the three primary colors.

In more detail, brightness of each of the red, green, and blue light emitted from the red, green, and blue color phosphor layers is divided into various levels, for example, 256 gradations each, and therefore, 16,770,000 colors can be represented by each of the unit pixels from the combinations of the red, green, and blue color lights that are divided into 256 gradations respectively.

The red color phosphor layer is formed of a fluorescent material such as $Y(V,P)O_4$:Eu, the green color phosphor layer is formed of a fluorescent material such as $Zn_2SiO_4$:Mn, or $YBO_3$:Tb, and the blue color phosphor layer is formed of a fluorescent material such as BAM:Eu. Since the red, green, and blue color phosphor layers are formed of fluorescent materials having different characteristics, the maximum emission brightness of the red, green, and blue light emitted from the red, green, and blue color phosphor layers are different from each other.

When the maximum emission brightness of the red, green, and blue colors are different from each other, the maximum emission brightness of the unit pixel is lowered due to the color having the lowest maximum emission brightness, and when the brightness of each of the red, green, and blue color lights are at the maximum emission brightness respectively, white light having a slight red color component having low color temperature is obtained by combining these three colors.

Figure 5:
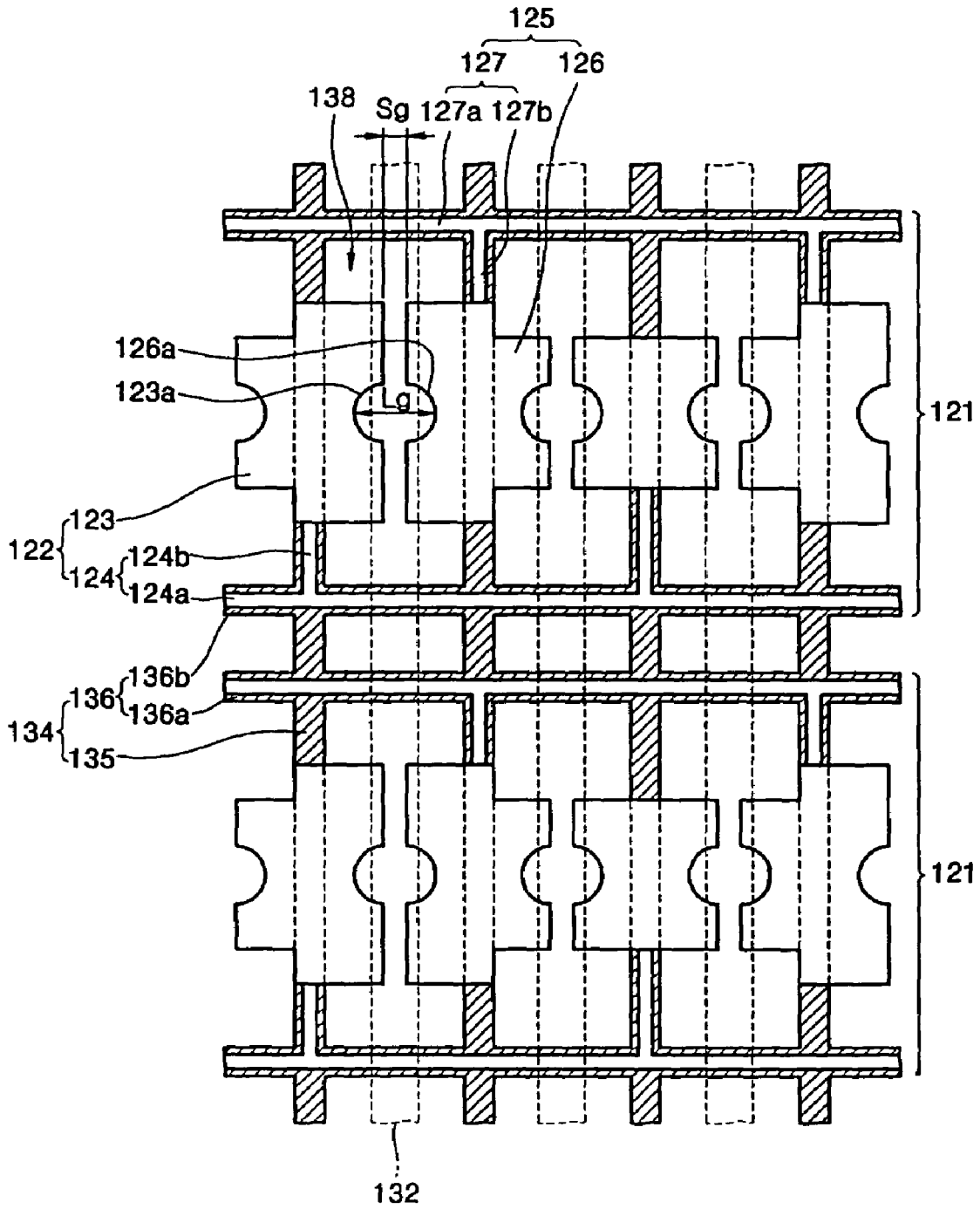
FIG. 5 is a plan view of a modified example of the sustain electrode pair of FIG. 4.

In order to improve the maximum brightness of the unit pixel and obtain the white color having a high color temperature, the pairs of sustain electrodes 121 can have the structure shown in FIG. 5.

Referring to FIG. 5, the portions of the first and second transparent electrodes 123 and 126 where the discharge occurs, which are portions disposed above the discharge cells 138 are formed differently at each discharge cell 138. That is, the portions of first and second transparent electrodes 123 and 126 disposed above the phosphor layer having the lowest maximum brightness have larger areas than the portions of the first and second transparent electrodes 123 and 126 disposed above the phosphor layers of other colors. The discharge areas of the first and second transparent electrodes 123 and 126 can be easily controlled by widening the first and second transparent electrodes 123 and 126 parallel to the direction in which the longitudinal barrier ribs 135 extend. According to this structure, the maximum brightness of the phosphor layer having the lowest maximum brightness level can be improved, and, accordingly, the maximum brightness of the unit pixel can be improved and white light having a high color temperature can be obtained.

As described above, address voltage margins that are required to excite the red, green, and blue phosphor layers can be changed according to the differences between the fluorescent material characteristics. The address voltage margin means a difference between a maximum value and a minimum value of the address voltage that can be used to maintain the stable discharge operation. When the address voltage margin of the phosphor layer having the smallest address voltage margin increases, the address discharge can be performed stably, and, accordingly, the portions of the first and second transparent electrodes 123 and 126 disposed on the phosphor layer having the smallest address voltage margin can be formed to have larger areas than the portions of the first and second transparent electrodes 123 and 126 disposed on the phosphor layers of other colors.

The operation of the plasma display panel 100 having the above structure will now be described.

When an address voltage is applied between the scan electrode, which is one of the first and second sustain electrodes 122 and 125, and the address electrode 132, an address discharge occurs, and the discharge cell 138 in which the sustain discharge occurs is the discharge cell 138 in which selected by the address discharge occurs. After the address discharge operation, a sustain voltage is alternately applied to the first and second sustain electrodes 122 and 125 disposed above the selected discharge cell 138, and the sustain discharge occurs between the first and second sustain electrodes 122 and 125. The sustain discharge starts from a short gap (Sg) between the first and second transparent electrodes 123 and 126, proceeds to the long gap (Lg), and is gradually diffused through the entire discharge cell 138. An energy level of the discharge gas that is excited by the sustain discharge becomes low, thus, ultraviolet rays are emitted. The ultraviolet rays excite the phosphor layer 137 formed in the discharge cell 138, and the excited phosphor layer 137 emits the visible rays to display an image.

Figure 6:
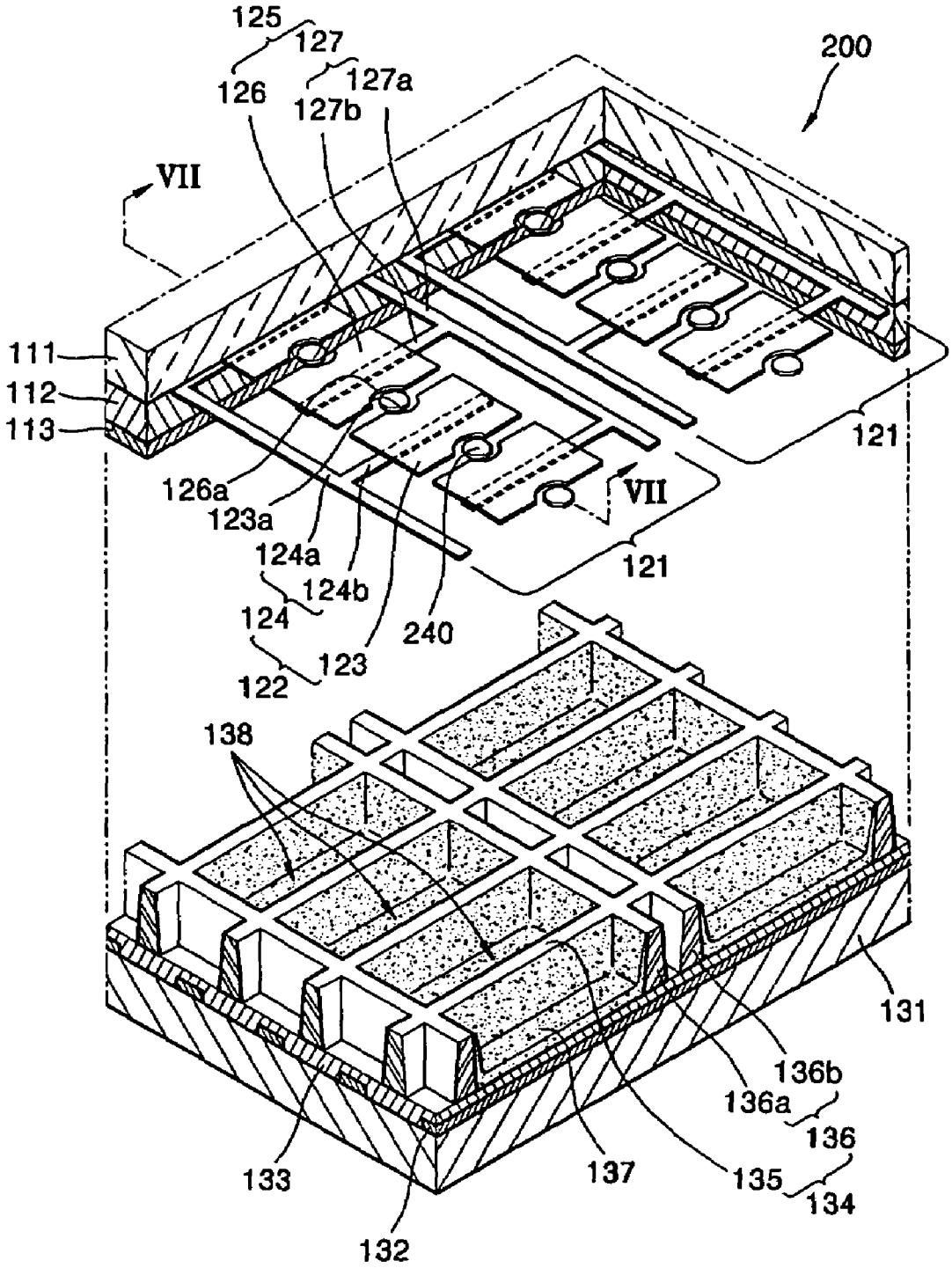
FIG. 6 is an exploded perspective view of a plasma display panel according to another embodiment of the present invention.
Figure 7:
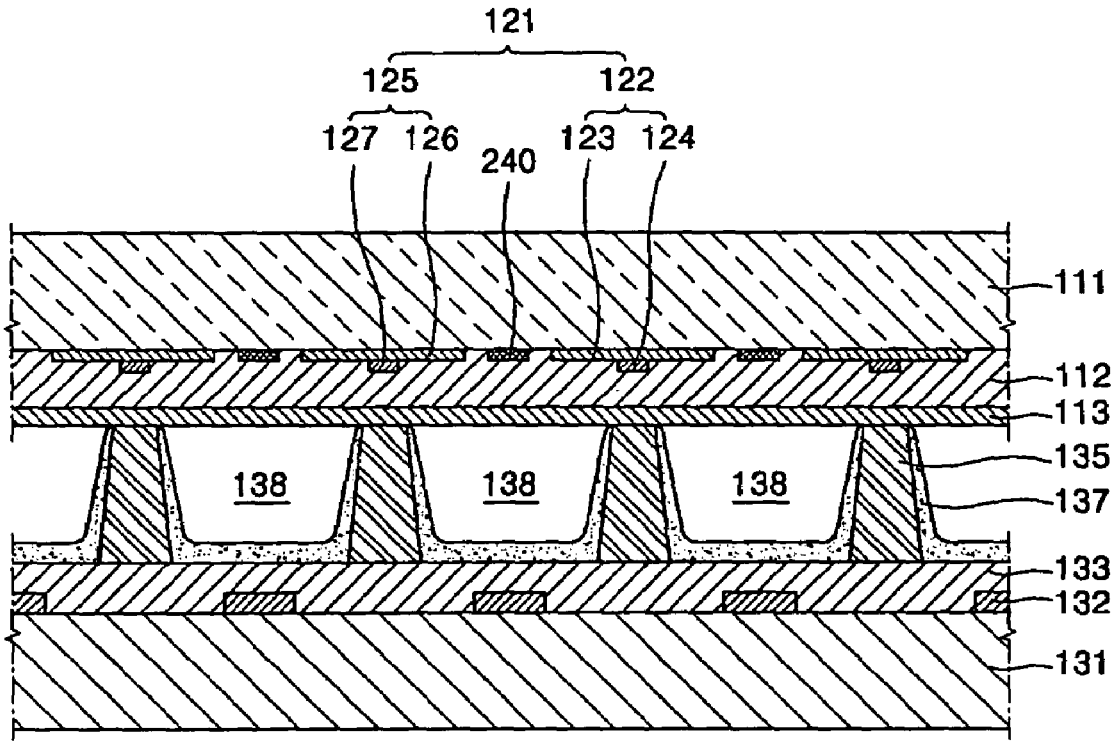
FIG. 7 is a cross-sectional view of the plasma display panel along line VII-VII of FIG. 6.
Figure 8:
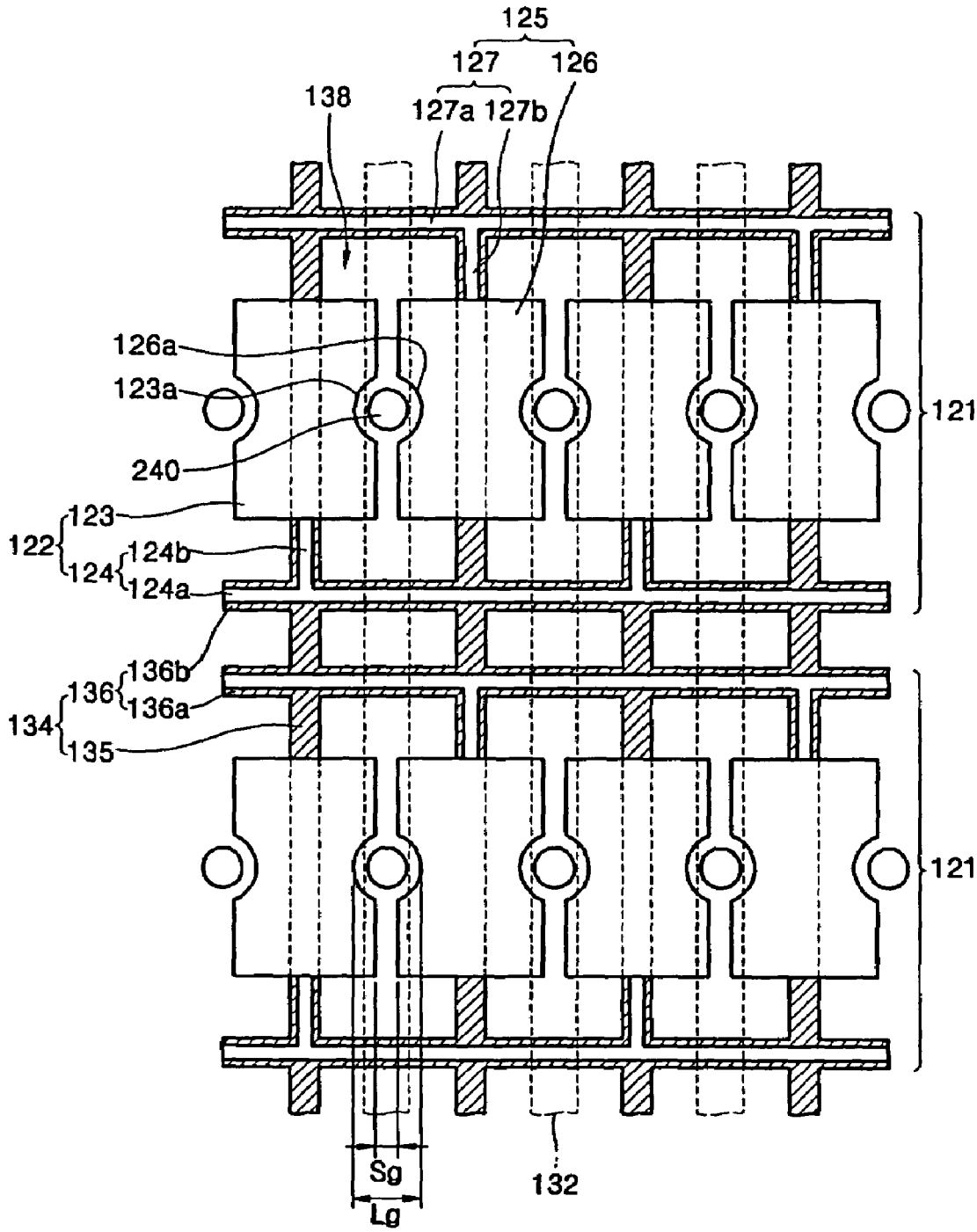
FIG. 8 is a plan view of sustain electrode pairs and a floating electrode arranged in a discharge cell in the plasma display panel of FIG. 6.

FIGS. 6 through 8 show a plasma display panel 200 according to another embodiment of the present invention. FIG. 6 is a perspective view of the plasma display panel 200, FIG. 7 is a cross-sectional view of the plasma display panel 200 along line VII-VII of FIG. 6, and FIG. 8 is a plan view of sustain electrode pairs of FIG. 6 disposed above a discharge cell. Like reference numerals in the drawings denote the same elements, thus detailed descriptions for those will be omitted.

Referring to FIGS. 6 through 8, in a plasma display panel 200, at least one floating electrode 240 is disposed between the first and second sustain electrodes 122 and 125 that generate the sustain discharge.

In more detail, the floating electrode 240 is buried in the upper dielectric layer 112, and can be disposed above the center of the discharge cell 138. In addition, the floating electrode 240 is disposed between the first recess portion 123*a* of the first transparent electrode 123 and the second recess portion 126*a* of the second transparent electrode 126 and separated from the first and second recess portions 123*a* and 126*a*. The floating electrode 240 can be formed, for example, in a shape corresponding to the shapes of the first and second recess portions 123*a* and 126*a*, and can therefore be shaped similar to the curves of the first and second recess portions 123*a* and 126*a* to be separated from the first and second recess portions 123*a* and 126*a* with constant intervals. That is, when the first and second recess portions 123*a* and 126*a* are formed to a predetermined radius from the center between the first and second transparent electrodes 123 and 126, the floating electrode 240 can be formed as a circular thin plate. However, the shape of the floating electrode 240 is not limited to this example.

The floating electrode 240 can be formed of a material such as ITO (indium tin oxide) in order not to interfere with the transmission of visible rays emitted from the phosphor layer 137 through the upper substrate 111. Since an additional voltage is not applied to the floating electrode 240, an induced voltage is formed on the floating electrode 240 by the voltages applied to the first and second sustain electrodes 122 and 125. The induced voltage can have an intermediate value between the voltages applied to the first and second sustain electrodes 122 and 125.

When the induced voltage is formed on the floating electrode 240, priming particles in the discharge cell 138 move actively and promote the formation of charged particles, and accordingly, the discharge can be performed efficiently. Accordingly, the plasma display panel can operate at a lower voltage, or an image with high brightness can be obtained when the same voltage is applied to panels according to the present embodiment and the conventional art in comparison. In addition, the sustain discharge generated between the first and second sustain electrodes 122 and 125 can be maximized, and the address discharge generated between the scan electrode, which is one of the first and second sustain electrodes 122 and 125, and the address electrode 132 can be maximized.

In addition, the sustain electrode pair 121 can be formed to have the structure shown in FIG. 5, in order to improve the maximum emission brightness of each unit pixel, obtain the white light having a high color temperature, and to ensure the address voltage margin is sufficient for performing the address discharge stably.

According to the present invention, since the first and second transparent electrodes disposed on the pair of first and second sustain electrodes protrude outward from the longitudinal barrier ribs over the discharge cells to form the discharge gap therebetween, the discharge area can be improved to be larger than that of the conventional art, and thus the plasma display panel can be driven with a low voltage and brightness can be improved. In addition, since the first and second transparent electrodes protrude outward from the longitudinal barrier ribs over the discharge cells, it is easy to control the size of a discharge area, and therefore the emission brightness and the color temperature can be increased and the address voltage margin can be sufficiently ensured. In addition, since the discharge gap between the first and second transparent electrodes includes the long gap section and the short gap section and the floating electrode can be disposed between the first and second transparent electrodes, the discharge stability can be ensured and the efficiency of the discharge operation can be improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel comprising:

an upper substrate;

an upper dielectric layer formed on a lower surface of said upper substrate;

a lower substrate facing said upper substrate;

a lower dielectric layer formed on an upper surface of said lower substrate;

a plurality of address electrodes disposed in said lower dielectric layer and spaced apart;

a plurality of barrier ribs, comprising longitudinal barrier ribs that extend between and parallel to said address electrodes and spaced apart, disposed between said upper substrate and said lower substrate;

a phosphor layer formed in discharge spaces disposed between said longitudinal barrier ribs; and a plurality of pairs of sustain electrodes disposed in said upper dielectric layer, each of the pairs comprising a first sustain electrode and a second sustain electrode disposed alternatively along the longitudinal barrier ribs, and protruding outward respectively from the major axis of longitudinal barrier ribs over the discharge space disposed between the longitudinal barrier ribs to form discharge gaps extending along a longitudinal direction of the discharge space.

2. The plasma display panel of claim 1, wherein:

said first sustain electrode including first transparent electrodes protruding outward from said longitudinal barrier ribs over the discharge spaces and a first bus electrode to which said first transparent electrodes are connected; and said second sustain electrode including second transparent electrodes protruding outward from said longitudinal barrier ribs over the discharge spaces to form discharge gaps with said first transparent electrodes and a second bus electrode to which said second transparent electrodes are connected.

3. The plasma display panel of claim 2, wherein said first transparent electrode is disposed above the discharge spaces on both sides of one of said longitudinal barrier ribs, and said second transparent electrode is disposed above the discharge spaces on both sides of another longitudinal barrier rib adjacent to the one of said barrier ribs.

4. The plasma display panel of claim 2, wherein said first bus electrode includes a first base portion extending perpendicularly to said longitudinal barrier ribs, and first connection portions extending from said first base portion toward said first transparent electrodes and connected to said first transparent electrodes, and said second bus electrode includes a second base portion extending perpendicular to said longitudinal barrier ribs, and second connection portions extending from said second base portion toward said second transparent electrodes and connected to said second transparent electrodes.

5. The plasma display panel of claim 4, wherein said barrier ribs further comprise transverse barrier ribs that extend perpendicular to said longitudinal barrier ribs and are separated from each other, and said first and second base portions are separately disposed on said transverse barrier ribs that are adjacent to each other.

6. The plasma display panel of claim 5, wherein each of said transverse barrier ribs includes a first transverse barrier rib and a second transverse barrier rib that are spaced apart.

7. The plasma display panel of claim 4, wherein said first and second connection portions are alternatively disposed on said longitudinal barrier ribs.

8. The plasma display panel of claim 4, wherein said first and second connection portions extend to edges of said first transparent electrodes and pass through center portions of said first and second transparent electrodes.

9. The plasma display panel of claim 4, wherein each of said first and second bus electrodes includes a black color layer.

10. The plasma display panel of claim 1, wherein said phosphor layer comprises first, second, and third color phosphor layers emitting first colored lights, second colored lights, and third colored lights respectively, and areas of portions of said first and second transparent electrodes that are disposed above said phosphor layer and have the lowest maximum brightness level are greater than those of portions of the first and second transparent electrodes that are disposed above the other phosphor layers.

11. The plasma display panel of claim 1, wherein said phosphor layer includes red, green, and blue color phosphor layers emitting of red, green, and blue lights respectively, and areas of portions of said first and second transparent electrodes that are disposed above said phosphor layer having said lowest address voltage margin are greater than those of portions of said first and second transparent electrodes that are disposed above the other phosphor layers.

12. The plasma display panel of claim 1, wherein recess portions are formed at edges of said first and second transparent electrodes forming the discharge gap, said recess portions form a long gap, and the remaining portions of said first and second transparent electrodes form a short gap that is shorter than the long gap.

13. The plasma display panel of claim 12, wherein said recess portions include predetermined curvatures.

14. The plasma display panel of claim 1, further comprising a protective layer formed on the lower surface of said upper dielectric layer.

15. The plasma display panel of claim 1, wherein one of said first and second sustain electrodes functions as a common electrode, and the other functions as a scan electrode.

16. The plasma display panel of claim 5, wherein a pitch between said transverse barrier ribs is three times greater than a pitch between said longitudinal barrier ribs.

17. The plasma display panel of claim 1, further comprising at least one floating electrode between said first transparent electrode and said second transparent electrode.

18. The plasma display panel of claim 17, wherein recess portions are formed at edges of said first and second transparent electrodes forming the discharge gap, and said floating electrode is disposed between said first and second recess portions.

19. The plasma display panel of claim 18, wherein said first and second recess portions have predetermined curvatures, and said floating electrode is formed to be separated from said first and second recess portions by a uniform distance at all points of said recess portions.

20. A plasma display panel comprising:

an upper substrate;

an upper dielectric layer formed on a lower surface of said upper substrate;

a lower substrate facing said upper substrate;

a lower dielectric layer formed on an upper surface of said lower substrate;

a plurality of address electrodes disposed in said lower dielectric layer and spaced apart;

a plurality of barrier ribs, comprising longitudinal barrier ribs that extend between and parallel to said address electrodes and spaced apart, disposed between said upper substrate and said lower substrate;

a phosphor layer formed in discharge spaces disposed between said longitudinal barrier ribs; and a plurality of pairs of sustain electrodes disposed in said upper dielectric layer, with each pair of sustain electrodes comprising a first sustain electrode and a second sustain electrode, each of the first sustain electrode and the second sustain electrode being formed of a comb structure having a base electrode and a plurality of comb fingers extending from the base structure along every other longitudinal barrier ribs, and the plurality of comb fingers of the first sustain electrode being interdigitated with the plurality of comb fingers of the second sustain electrode.

* * * * *